US009677495B2

(12) United States Patent
Shibata et al.

(10) Patent No.: US 9,677,495 B2
(45) Date of Patent: Jun. 13, 2017

(54) FUEL RAIL PRESSURE CONTROL SYSTEMS AND METHODS

(75) Inventors: Jonathan T. Shibata, Whitmore Lake, MI (US); Joshua D. Cowgill, Hartland, MI (US); Daniel Sabathil, Seeheim-Jugenheim (DE); David P. Sczomak, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 510 days.

(21) Appl. No.: 13/053,639

(22) Filed: Mar. 22, 2011

(65) Prior Publication Data

US 2012/0185152 A1 Jul. 19, 2012

Related U.S. Application Data

(60) Provisional application No. 61/434,174, filed on Jan. 19, 2011.

(51) Int. Cl.
*F02M 69/54* (2006.01)
*F02D 41/38* (2006.01)

(52) U.S. Cl.
CPC ..... *F02D 41/3836* (2013.01); *F02D 41/3845* (2013.01); *F02D 2200/021* (2013.01); *F02D 2200/101* (2013.01); *F02D 2250/31* (2013.01)

(58) Field of Classification Search
CPC ..... F02D 2250/31; F02D 2200/0606; F02D 2200/0602; F02D 41/3082; F02D 41/3836; F02D 41/3845; F02D 41/40; F02B 1/04; F02B 2075/027; F02B 3/06
USPC ..... 123/435, 436, 456, 457, 458, 510, 511; 701/103
See application file for complete search history.

(56) References Cited

U.S. PATENT DOCUMENTS

| | | | | |
|---|---|---|---|---|
| 4,010,717 | A * | 3/1977 | Taplin | 123/492 |
| 4,408,279 | A | 10/1983 | Imai et al. | |
| 4,596,221 | A | 6/1986 | Ament et al. | |
| 4,635,603 | A * | 1/1987 | Hara | 123/383 |
| 4,682,577 | A * | 7/1987 | Kato et al. | 123/406.46 |
| 4,711,216 | A * | 12/1987 | Takeuchi et al. | 123/447 |
| 5,012,780 | A * | 5/1991 | Bugamelli | F02B 67/00 123/478 |
| 5,183,013 | A | 2/1993 | Ito et al. | |

(Continued)

FOREIGN PATENT DOCUMENTS

| | | | |
|---|---|---|---|
| DE | 10047001 | A1 | 4/2002 |
| DE | 102006000242 | A1 | 11/2006 |

OTHER PUBLICATIONS

U.S. Appl. No. 12/944,044, Shibata et al., filed Nov. 11, 2010.
U.S. Appl. No. 13/036,282, Shibata et al., filed Feb. 28, 2011.
U.S. Appl. No. 13/027,531, Cowgill et al., filed Feb. 15, 2011.

*Primary Examiner* — Hai Huynh
*Assistant Examiner* — Gonzalo Laguarda

(57) ABSTRACT

A fuel control system includes a target rail pressure module. The target rail pressure module determines a target fuel rail pressure of a fuel rail of a direct injection engine. An offset module determines an offset value based on an engine speed of the direct injection engine and at least one of an engine load and an air per cylinder. A modifier module determines a modifier value based on a temperature of the direct injection engine. A rail pressure control module adjusts a current fuel rail pressure of the fuel rail based on the target fuel rail pressure, the offset value and the modifier value.

20 Claims, 5 Drawing Sheets

(56) References Cited

U.S. PATENT DOCUMENTS

| | | | | |
|---|---|---|---|---|
| 5,237,975 | A * | 8/1993 | Betki et al. | 123/497 |
| 5,243,947 | A * | 9/1993 | Yamamoto et al. | 123/458 |
| 5,261,378 | A | 11/1993 | Fenchel et al. | |
| 5,355,859 | A * | 10/1994 | Weber | 123/497 |
| 5,617,830 | A | 4/1997 | Ishiwata et al. | |
| 5,630,402 | A | 5/1997 | Devine et al. | |
| 5,809,446 | A | 9/1998 | Visser | |
| 6,325,044 | B1 | 12/2001 | Chen et al. | |
| 6,962,140 | B1 | 11/2005 | Nakai et al. | |
| 7,066,155 | B2 * | 6/2006 | Uhde et al. | 123/525 |
| 7,140,348 | B2 | 11/2006 | Takeuchi et al. | |
| 7,246,595 | B1 | 7/2007 | Hoare et al. | |
| 7,475,671 | B1 | 1/2009 | Fattic et al. | |
| 7,624,719 | B2 * | 12/2009 | Achleitner et al. | 123/456 |
| 7,715,974 | B2 | 5/2010 | Gibson et al. | |
| 7,774,125 | B2 * | 8/2010 | Scharfenberg | 701/103 |
| 7,775,191 | B2 * | 8/2010 | Hou | 123/458 |
| 7,853,398 | B2 * | 12/2010 | Hirowatari et al. | 701/104 |
| 8,042,520 | B2 * | 10/2011 | Miller et al. | 123/458 |
| 8,210,156 | B2 * | 7/2012 | Kokotovic et al. | 123/458 |
| 8,521,399 | B2 | 8/2013 | Peters et al. | |
| 8,539,933 | B2 | 9/2013 | Cowgill et al. | |
| 8,645,043 | B2 | 2/2014 | Shibata et al. | |
| 2007/0089704 | A1 | 4/2007 | Jacobsson et al. | |
| 2008/0196695 | A1 * | 8/2008 | Storhok | F02D 41/064 123/478 |
| 2008/0264387 | A1 * | 10/2008 | Spivak | 123/457 |
| 2009/0071444 | A1 * | 3/2009 | Takagi et al. | 123/447 |
| 2009/0234557 | A1 | 9/2009 | Hirowatari et al. | |
| 2009/0288638 | A1 * | 11/2009 | Dintino | F02D 41/3863 123/447 |
| 2009/0299610 | A1 | 12/2009 | Kumano et al. | |
| 2010/0101536 | A1 * | 4/2010 | Nakata | 123/457 |
| 2011/0000463 | A1 | 1/2011 | Kokotovic et al. | |
| 2011/0066351 | A1 | 3/2011 | Gallagher et al. | |
| 2012/0080009 | A1 | 4/2012 | Shibata et al. | |
| 2012/0180763 | A1 * | 7/2012 | Cowgill et al. | 123/478 |
| 2012/0185151 | A1 | 7/2012 | Shibata et al. | |
| 2012/0185152 | A1 | 7/2012 | Shibata et al. | |

* cited by examiner

FUEL RAIL PRESSURE CONTROL SYSTEMS AND METHODS

CROSS-REFERENCE TO RELATED APPLICATIONS

This application claims the benefit of U.S. Provisional Application No. 61/434,174, filed on Jan. 19, 2011. The disclosure of the above application is incorporated herein by reference in its entirety.

FIELD

The present disclosure relates to engine control systems and more particularly to fuel rail pressure control systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel system for a spark ignition direct injection (SIDI) engine may include a low-pressure fuel pump and a high-pressure fuel pump. The low-pressure fuel pump pumps fuel from a fuel tank to a low-pressure fuel line. The high-pressure fuel pump pumps fuel from the low-pressure fuel line to a high-pressure fuel line and/or fuel rail. Fuel injectors on the SIDI engine receive fuel at a high-pressure from the fuel rail. The fuel injectors directly inject fuel into combustion chambers of cylinders of the SIDI engine. This is different than a conventional multi-point fuel injection that includes injecting fuel into an intake tract or cylinder port.

Direct injection enables stratified fuel-charged combustion, which can provide improved fuel efficiency, reduced emissions and increased power output during normal engine operating temperatures (e.g., approximately 90° C.). Emissions output of a SIDI engine is generally greater during a cold engine start when operating at the normal engine operating temperatures. During a cold engine start (e.g., engine operating temperature of less than approximately 50° C.), fuel is injected in the combustion chambers and can impinge on top surfaces of pistons and on cylinder walls. This can prevent a complete combustion of the injected fuel, as the fuel on the top of the pistons and on the cylinder walls may not be fully ignited during ignition strokes. As a result, an increased amount of particulate may be generated during a combustion cycle and exhausted from the SIDI engine to an exhaust system.

SUMMARY

A fuel control system is provided and includes a target rail pressure module. The target rail pressure module determines a target fuel rail pressure of a fuel rail of a direct injection engine. An offset module determines an offset value based on an engine speed and at least one of an engine load and an air per cylinder of the direct injection engine. A modifier module determines a modifier value based on a temperature of the direct injection engine. A rail pressure control module adjusts a current fuel rail pressure of the fuel rail based on the target fuel rail pressure, the offset value and the modifier value.

In other features, a fuel control method is provided. The method includes determining a target fuel rail pressure of a fuel rail of a direct injection engine based on an engine speed and at least one of an engine load and an air per cylinder of the direct injection engine. An offset value is determined based on the engine speed and at least one of the engine load and the air per cylinder. A modifier value is determined based on a temperature of the direct injection engine. A current fuel rail pressure of the fuel rail is adjusted based on the target fuel rail pressure, the offset value and the modifier value.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
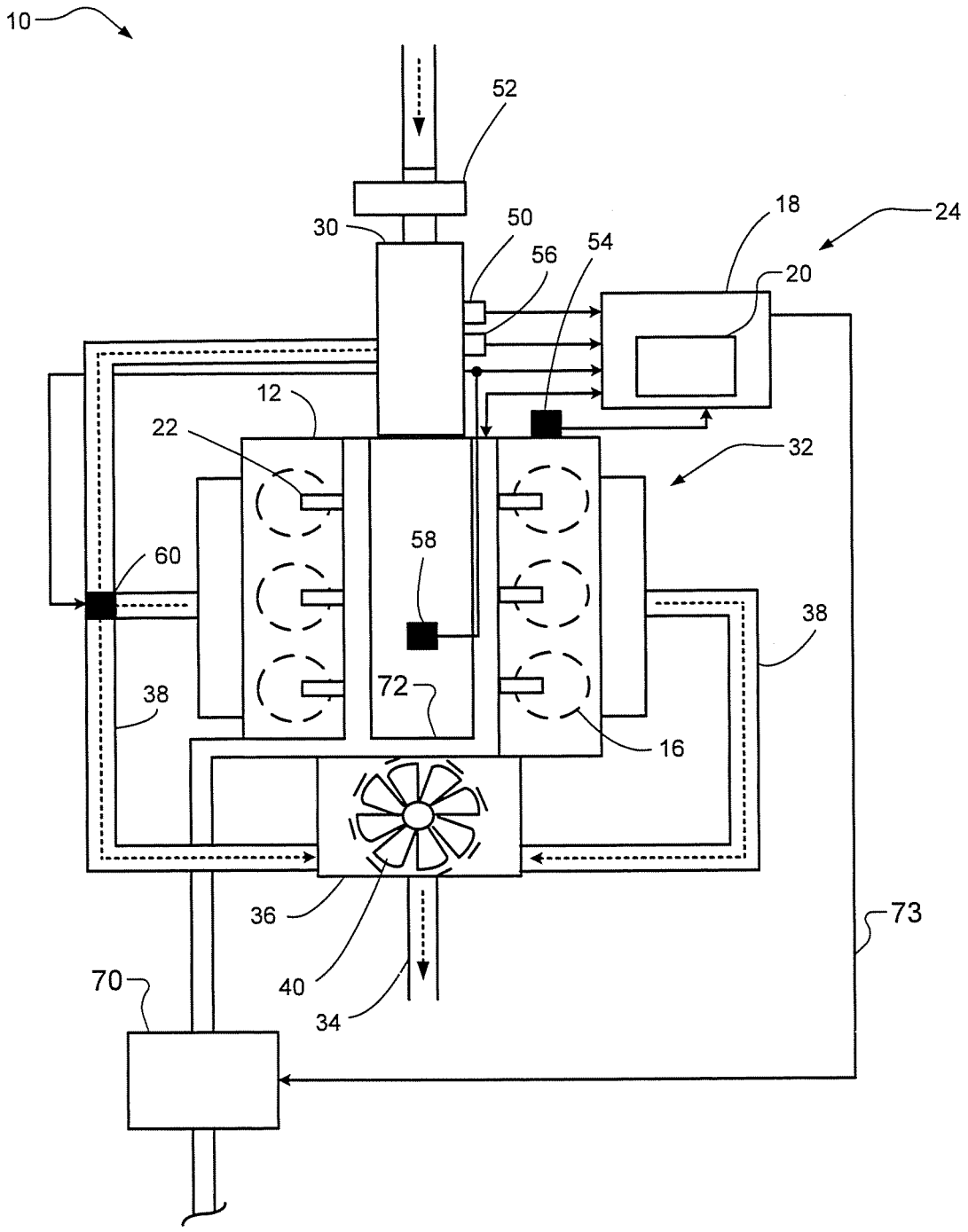
FIG. 1 is a functional block diagram of an engine control system that includes a fuel control system in accordance with the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module to an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of the above, such as a system-on-chip. The term module may include non-transitory memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Referring now to FIG. 1, an engine control system 10 is shown. The engine control system 10 includes an engine 12 and a fuel control system 14. The engine 12 may be a spark ignition direct injection (SIDI) engine. The fuel control system 14 controls a supply of fuel to cylinders 16 of the engine 12. The fuel control system 14 includes an engine control module (ECM) 18, which in turn includes a fuel control module (FCM) 20. The FCM 20 controls a pressure of fuel provided to fuel injectors 22 of each of the cylinders 16. The FCM 20 adjusts fuel pressure to the fuel injectors 22 based on, for example, temperatures of the engine 12.

The engine 12 includes an intake manifold 30, a fuel injection system 32 having the fuel injectors 22, an exhaust system 34 and may include a turbocharger 36. Although six cylinders are shown, the engine 12 may include any number of cylinders in various configurations. While a gasoline powered internal combustion engine utilizing direct injection is contemplated, the disclosure may also apply to diesel or alternative fuel sources.

During engine operation, air is drawn into the intake manifold 30 by an inlet vacuum created by an intake stroke of the engine 12. Air is drawn into the cylinders 16 from the intake manifold 30 and is compressed therein. Fuel is injected into the cylinders 16 by the fuel injection system 32 and mixes with the air in the cylinders 16 to form an air/fuel mixture. The air/fuel mixture is compressed and the heat of compression and/or electrical energy (via e.g., spark plugs) ignites the air/fuel mixture. Exhaust gas is exhausted from the cylinders 16 through exhaust conduits 38. The exhaust gas may drive the turbine blades 40 of the turbocharger 36, which in turn drives compressor blades (not shown). The compressor blades can deliver additional air (boost) to the intake manifold 30 and into the cylinders 16 for combustion.

The engine control system 10 and/or the fuel control system 14 may include a manifold absolute pressure (MAP) sensor 50, a mass air flow (MAF) sensor 52, an engine speed sensor 54, an intake manifold temperature sensor 56, engine temperature sensors 58 (one is shown), and other various engine sensors. The MAP sensor 50 is located on the intake manifold 30 and provides a manifold pressure signal MAP based on the pressure in the intake manifold 30. The MAF sensor 52 is located within an air inlet and provides a mass air flow signal MAF based on the mass of air flowing into the intake manifold 30. The FCM 20 controls the fuel (including the pressure of the fuel) supplied to the engine 12 based on the mass air flow signal MAF. The engine speed sensor 54 may be, for example, a crankshaft position sensor and generates an engine speed signal RPM. The intake manifold temperature sensor 56 generates an intake air temperature signal. The engine temperature sensors 58 may monitor temperature of a coolant and/or oil of the engine 12. The engine temperature sensors 58 may generate, for example, an engine temperature signal Teng, a coolant temperature signal Tcool, and/or an oil temperature signal Toil.

The exhaust conduits 38 may include an exhaust recirculation (EGR) valve 60. The EGR valve 60 can recirculate a portion of the exhaust. The ECM 18 can control the EGR valve 60 to achieve a desired EGR rate.

The fuel injection system 32 may further include a high-pressure pump assembly 70 that provides fuel at a high-pressure (i.e. a pressure greater than a predetermined pressure) to a high-pressure fuel line and/or fuel rail 72. The high-pressure pump assembly 70 adjusts the pressure of the fuel supplied to the fuel rail based on a high-pressure pump signal HIGH (73) from the FCM 20. The fuel rail 72 is connected to the fuel injectors 22. The highly pressurized fuel is supplied from the fuel rail 72 to the cylinders 16 via the fuel injectors 22.

Figure 2:
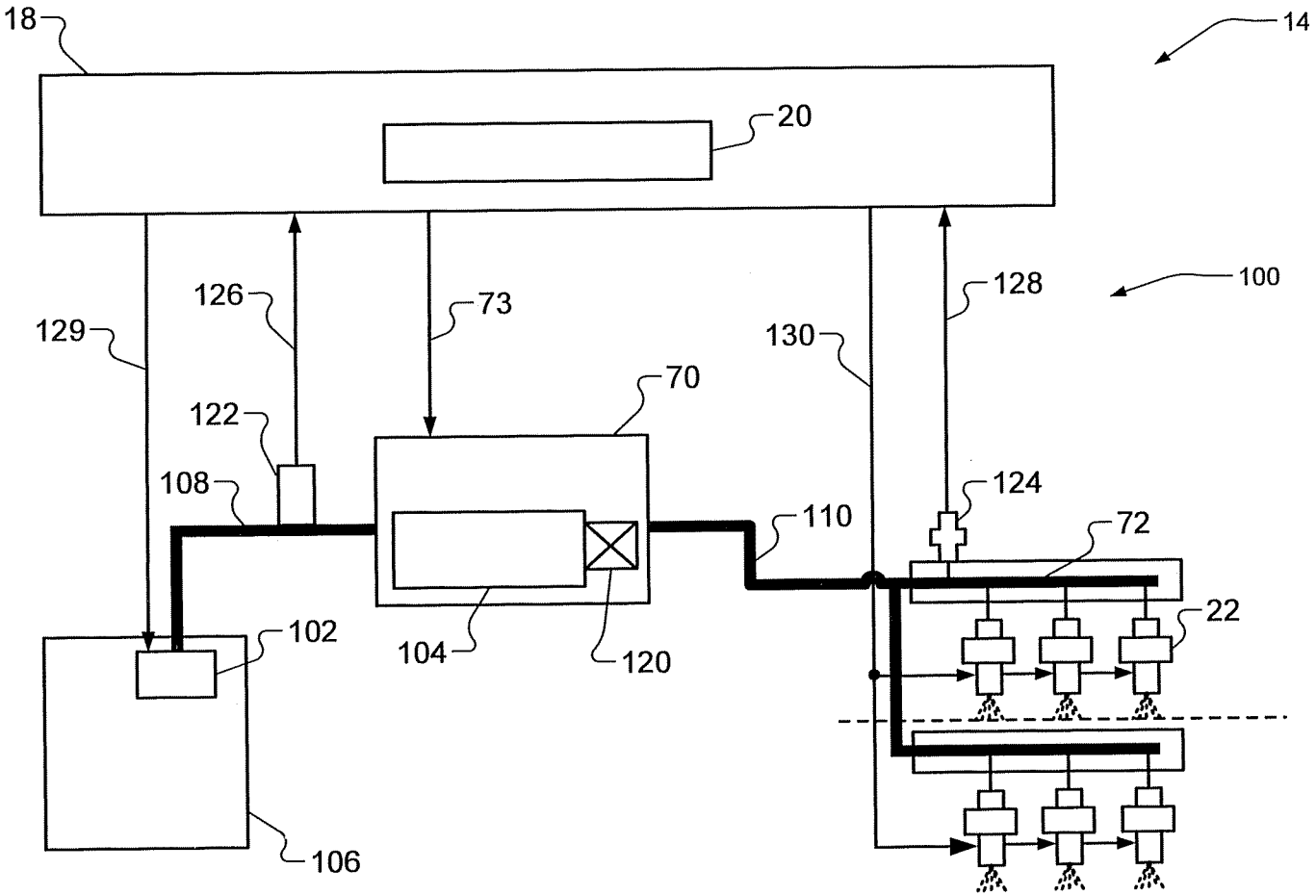
FIG. 2 is a functional block diagram of the fuel control system of FIG. 1 including a fuel rail pressure control system in accordance with the present disclosure.

Referring now also to FIG. 2, the fuel control system 14 is shown and includes a fuel rail pressure control system 100. The fuel control system 14 includes the ECM 18, the FCM 20, a low-pressure fuel pump 102, and the high-pressure pump assembly 70 with a high-pressure fuel pump 104.

The low-pressure fuel pump 102 pumps fuel from a fuel tank 106 to a low-pressure fuel line 108. Fuel pressure in the low-pressure fuel line 108 is greater than a first predetermined pressure and less than or equal to a second predetermined pressure. The high-pressure fuel pump 104 pumps fuel from the low-pressure fuel line 108 to a high-pressure fuel line 110 and/or the fuel rail 72. Fuel pressure in the fuel rail 72 is greater than the second predetermined pressure and/or greater than a third predetermined pressure. The third predetermined pressure may be greater than the second predetermined pressure. Fuel in the fuel rail 72 is received at a high-pressure by the fuel injectors 22. The fuel injectors 22 directly inject fuel into combustion chambers of the cylinders 16.

The high-pressure pump assembly 70 includes the high-pressure fuel pump 104 and a high-pressure valve 120. The high-pressure pump assembly 70 receives low-pressure fuel through the low-pressure fuel line 108, increases pressure of the fuel and provides high-pressure fuel to the fuel rail 72. The high-pressure fuel pump 104 may include various types of designs including a design using a cam that turns and moves a pumping member to increase the pressure of the fuel. The fuel pressure in the fuel rail 72 may be adjusted based on open time of the high-pressure valve. For example, the longer the high-pressure valve 120 is open the higher the pressure in the fuel rail 72. As such, the FCM 20 may control pressure of the fuel in the fuel rail 72 by controlling operation of the high-pressure valve 120 including open time of the high-pressure valve 120 and/or the extent that the high-pressure valve 120 is opened. The extent that the high-pressure valve 120 is open refers to open position of the high-pressure value 120 and/or the size of the opening associated with the open position of the high-pressure valve 120. Examples of this control are also described with respect to FIGS. 3-5.

The fuel rail pressure control system 100 may include a low-pressure sensor 122 and a high-pressure sensor 124. The low-pressure sensor 122 detects pressure in the low-pressure fuel line 108 and generates a low-pressure sensor signal 126. The high-pressure sensor 124 detects pressure in the fuel rail 72 and generates a high-pressure sensor signal 128. The ECM 18 and/or the FCM 20 may adjust operation of the low-pressure fuel pump 102, the high-pressure fuel pump 104, the high-pressure valve 120, and/or the fuel injectors 22 by generating a low-pressure pump signal LOW (129), a high-pressure pump signal HIGH and/or fuel injectors signals INJ (130) based on the low-pressure sensor signal and/or the high-pressure sensor signal 128.

Figure 3:
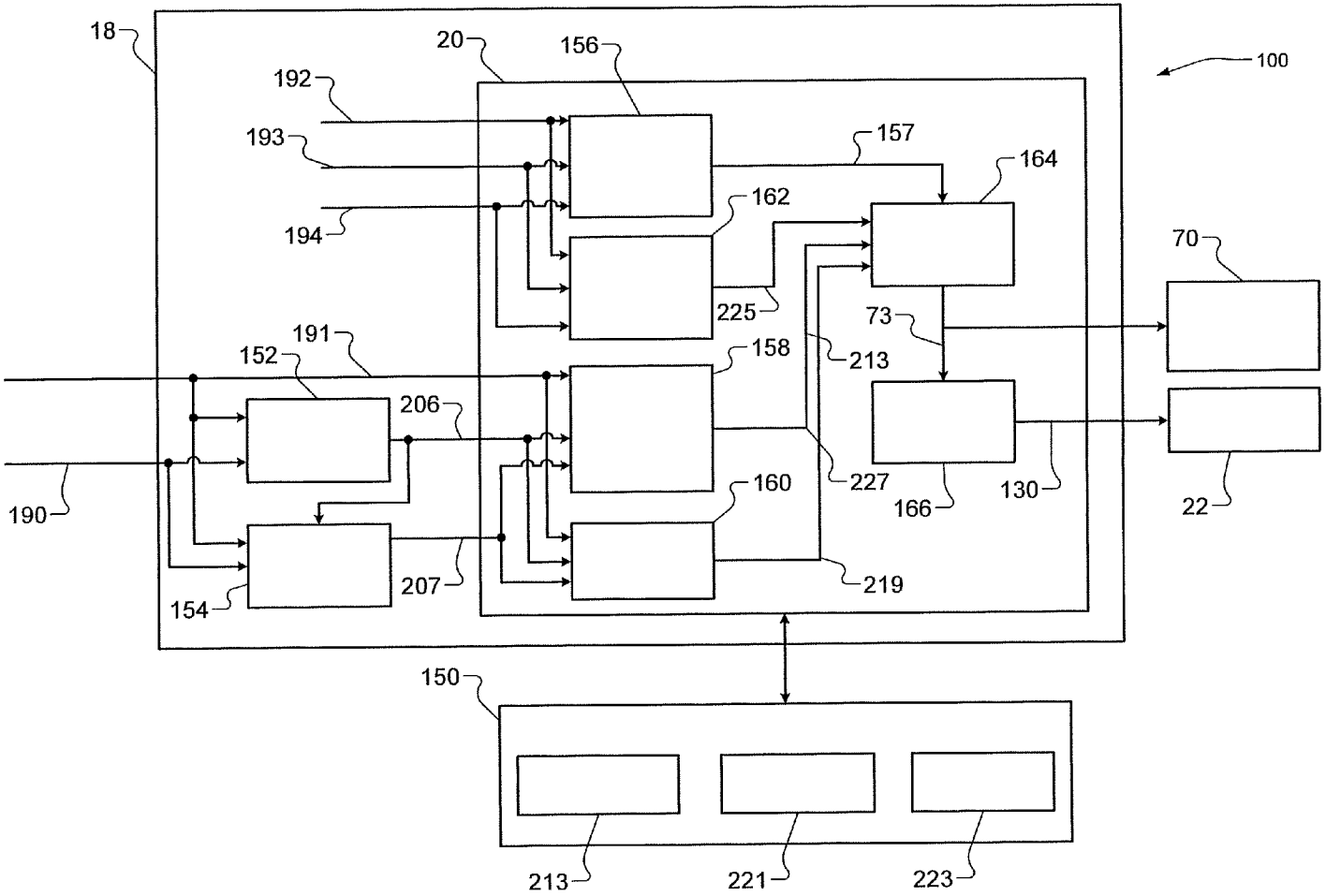
FIG. 3 is a functional block diagram of the fuel rail pressure control system of FIG. 2.

Referring now also to FIG. 3, the fuel rail pressure control system 100 is shown. The fuel rail pressure control system 100 includes the ECM 18, the FCM 20, the fuel injectors 22, the high-pressure pump assembly 70 and memory 150. The memory 150 may be included as part of the ECM 18, the FCM 20 or may be distinct from the ECM 18, as shown. The ECM 18 includes an air per cylinder (APC) module 152, an engine load module 154 and the FCM 20. The FCM 20 includes a mode determining module 156, a target rail pressure module 158, an offset module 160, a modifier module 162, a rail pressure control module 164 and a fuel injector control module 166.

The mode-determining module 156 determines an operating mode of the ECM 18, the FCM 20 and/or the fuel rail pressure control system 100. Different operating modes may include a normal pressure (or first pressure) mode, a high-pressure (or second pressure) mode, and/or a continuous pressure adjusting (or third pressure) mode. The mode-determining module 156 generates a mode signal MODE (157) that indicates the operating mode.

The normal pressure mode may include providing fuel in the fuel rail 72 at a normal operating pressure when a temperature of the engine 12 is greater than a predetermined temperature and/or at a normal operating temperature (e.g., 90° C.). The normal operating pressure may refer to a pressure or pressure range associated with operating the engine 12 at the normal operating temperature and/or within a normal operating temperature range. The normal operating temperatures and pressures may refer to temperatures and pressures experienced when the engine 12 is, for example, in a steady state warmed up condition.

The high-pressure mode may include providing fuel in the fuel rail 72 at an increased pressure when a temperature of the engine 12 is less than a predetermined temperature (e.g., 50° C.). Fuel pressure used during the high-pressure mode may be greater than fuel pressure used during the normal pressure mode. The lowest fuel pressure used during the high-pressure mode may be greater than or equal to the highest fuel pressure used during the normal pressure mode, depending upon, for example fuel demands on and/or loading of the engine 12.

The continuous pressure adjusting mode may include periodically and/or continuously adjusting pressure of the fuel in the fuel rail 72 based on one or more of, for example, an air per cylinder, an engine load, an engine speed, a temperature of the engine 12, etc. The continuous pressure adjusting mode may include adjusting fuel pressure in the fuel rail 72 for any operating temperature of the engine 12. This may include temperatures experienced during a cold start of the engine 12. An example cold start temperature range is 10° C.-50° C.

Figure 4:
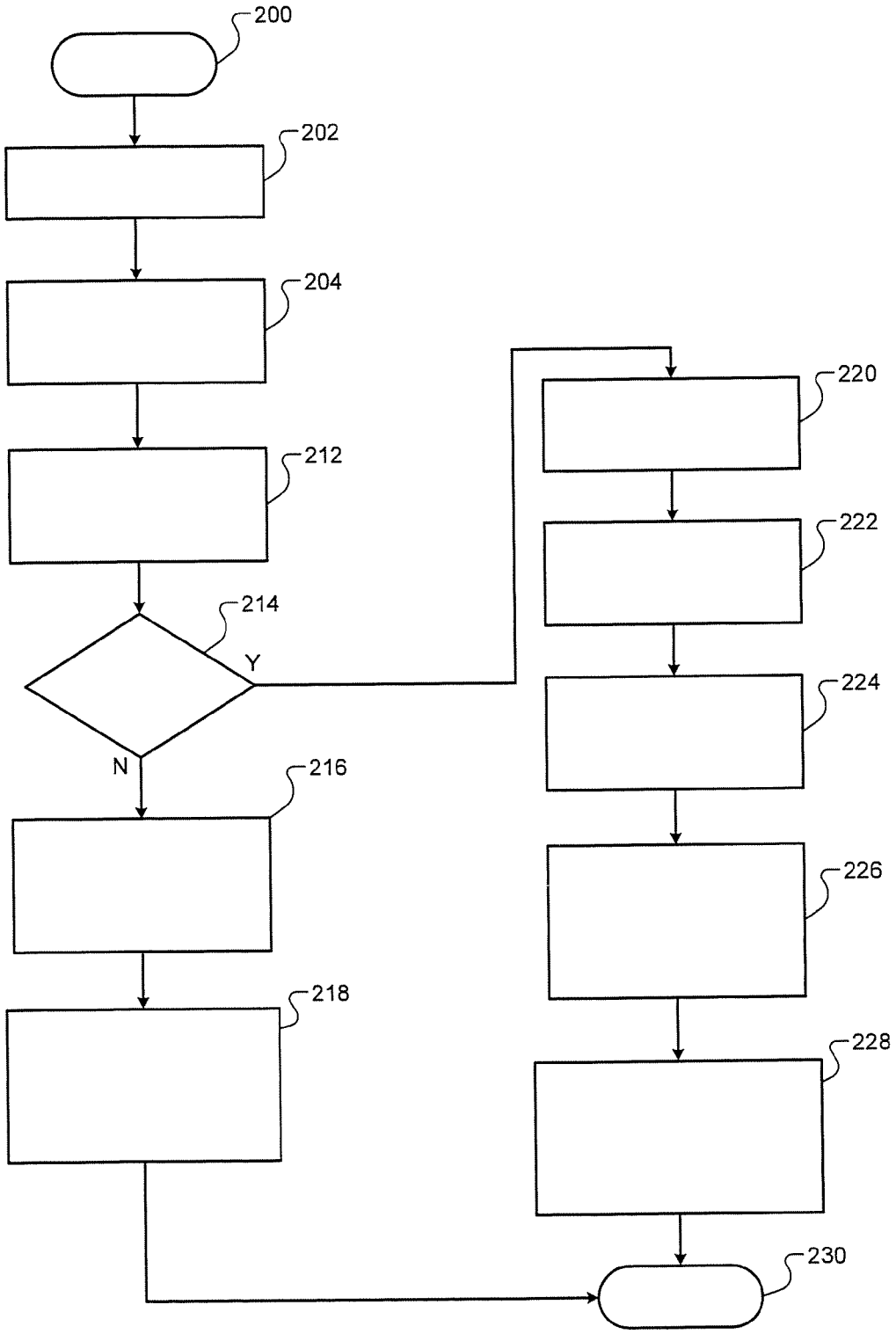
FIG. 4 is a fuel control method in accordance with the present disclosure.

The modules 152-166 are further described below in combination with the method of FIG. 4. Referring now primarily to FIGS. 3 and 4, a fuel control method is shown. The fuel control system 14 and the fuel rail pressure control system 100 may be operated using numerous methods, an example method is provided by the method of FIG. 4. In FIG. 4, an example a fuel control method is shown. Although the following tasks are primarily described with respect to the implementations of FIGS. 1-3, the tasks may be easily modified to apply to other implementations of the present disclosure. The tasks may be iteratively performed. The method may be based on an algorithm and may begin at 200.

At 202, the ECM 18 and/or the FCM 20 collects sensor signals, such as the sensor signals described above and determine corresponding states of the engine 12. The sensor signals may include, for example, the mass air flow signal MAF (190), the engine speed signal RPM (191), the engine temperature signal Teng (192), the coolant temperature signal Tcool (193), and/or the oil temperature signal Toil (194). The states may include a current mass air flow rate, a current engine speed, a current engine temperature, a current coolant temperature, a current oil temperature, etc.

At 204, the APC module 152 determines air per cylinder value of the engine 12 and/or the engine load module 154 determines an engine load based on and/or as a function of the mass air flow rate and the engine speed indicated by the mass air flow signal MAF and the engine speed signal RPM. The APC module 152 generates an air per cylinder signal APC (206) and/or the engine load module 154 generates an engine load signal Leng (207), which respectively indicates the air per cylinder and the engine load of the engine 12. In one implementation, the air per cylinder signal APC is used to represent and/or in replacement of the engine load signal Leng. Accordingly, the engine load signal Leng may be generated based on and/or be set equal to the air per cylinder signal APC. The fuel rail pressure control system 100 may include the APC module 152 and/or the engine load module 154.

At 212, the target rail pressure module 158 determines a target fuel rail pressure Ptarg based on and/or as a function of the current engine speed, the current APC, and/or the current engine load, as indicated by the engine speed signal RPM, the air per cylinder signal APC and/or based on the engine load signal Leng. The target fuel rail pressure Ptarg refers to a fuel pressure of the fuel rail 72 that the FCM 20 is attempting to achieve. In one implementation, the target fuel rail pressure Ptarg is determined (looked up) using a target fuel rail pressure table (first table) 213 that relates target fuel rail pressure values to current engine speeds, current APC values, and/or current engine loads. The target fuel rail pressure table 213 may be stored in the memory 150. The target fuel rail pressure Ptarg may be the same as or different than a current fuel rail pressure. The target rail pressure module 158 generates a target fuel rail pressure signal 213 that indicates the target fuel rail pressure Ptarg.

At 214, the FCM 20 and/or the mode-determining module 156 determine an operating mode of the fuel rail pressure control system 100 and generate the mode signal MODE. The operating mode may be determined, for example, based on one or more temperatures of the engine 12. The operating mode may be based on the temperature signals Teng, Tcool, Toil. The mode-determining module 156 may select one of the normal pressure mode, the high-pressure mode, and/or the continuous pressure adjusting mode. Task 214 is used to determine whether to enable the normal pressure mode or the high-pressure mode. Task 214 may be performed at the beginning of the method, such as before task 204.

In one implementation, tasks 216-218 are performed when one or more temperatures of the engine 12 (e.g., the engine temperature Teng, the coolant temperature Tcool and/or the oil temperature Toil) are greater than a predetermined temperature (e.g., 50° C.). The fuel rail pressure control system 100 is operating in the normal pressure mode when performing tasks 216-218. Tasks 220-228 are performed when the temperature of the engine 12 is less than or equal to the predetermined temperature. The fuel rail pressure control system 100 is operating in the high-pressure mode when performing tasks 214 and 220-228.

In another example implementation, the task 214, 216 and 218 are not performed and tasks 220-228 are performed subsequent to task 212. The fuel rail pressure control system 100 may be operating in the continuous pressure adjusting mode when performing tasks 220-228 and when not performing tasks 214, 216 and 218.

At 216, the FCM 20 and/or the rail pressure control module 164 adjust a current fuel rail pressure based on the target fuel rail pressure Ptarg and the mode signal MODE. The rail pressure control module 164 generates the high-pressure pump signal HIGH and/or a high-pressure valve signal based on the target fuel rail pressure Ptarg determined at 212. The high-pressure valve signal may be provided to the high-pressure pump assembly 70 to control, for example, a solenoid of the high-pressure valve 120. The high-pressure valve signal may be included in the high-pressure pump signal and be used to adjust the open time and/or extent to which the valve is open.

Figure 5:
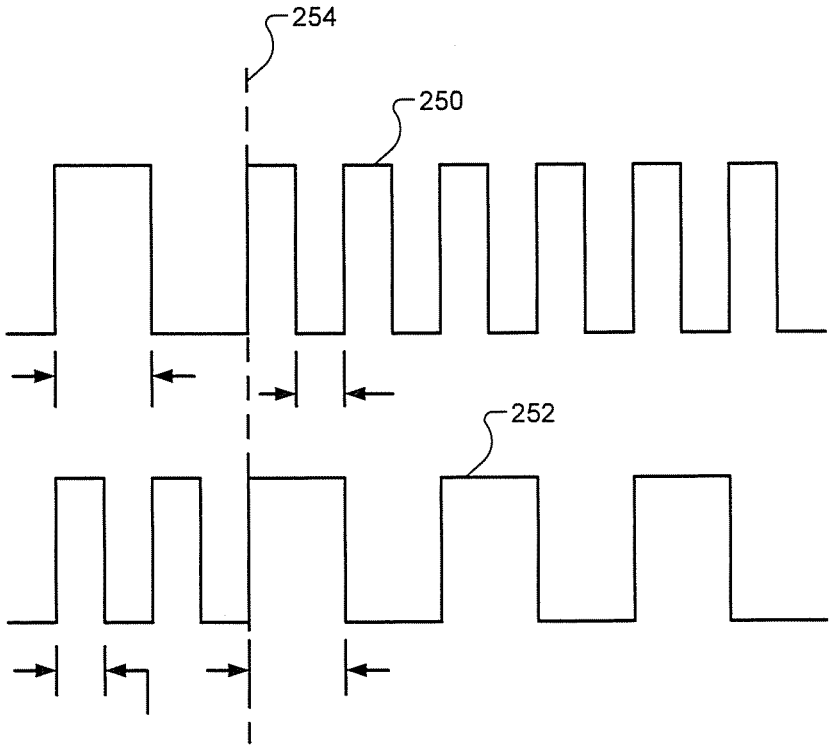
FIG. 5 is a plot of a high-pressure valve signal and a fuel injector signal in accordance with the present disclosure.

At 218, the FCM 20 and/or the fuel injector control module 166 may adjust the fuel injector signals INJ based on the mode signal MODE and based on and/or as a function of the target fuel rail pressure Ptarg and/or the current fuel rail pressure. For example, if the target fuel rail pressure Ptarg is less than the current fuel rail pressure, then the fuel rail pressure in the fuel rail 72 is to be decreased and the injector ON (or OPEN) time may be increased. This may be done to maintain a current amount of fuel being supplied to the cylinders 16 (fuel supply rate) of the engine 12. The rail pressure may be decreased and the injector ON time may be increased by adjusting respective ON time pulse widths, frequencies and/or duty cycles of signals provided to the high-pressure valve and the fuel injectors INJ. The high-pressure pump signal may include a high-pressure valve signal. The high-pressure valve signal and the fuel injector signals may be pulse-width modulated (PWM) signals, as shown in FIG. 5.

At 220, the offset module 160 determines an offset value OFFSET based on and/or as a function of the current engine speed, the current APC, and/or the current engine load, as indicated by the engine speed signal RPM, the air per cylinder signal APC and/or based on the engine load signal Leng. The offset module 160 generates an offset signal 219 that indicates the offset value OFFSET. In one implementation the offset value is determined (looked up) using an offset table (second table) 221 that relates offset values to the current engine speed, the current APC, and/or the current engine load. The offset table 221 may be stored in the memory 150. The offset value OFFSET is used in task 224 to offset the target fuel rail pressure Ptarg determined at 212.

At 222, the modifier module 162 determines a modifier value MOD based on one or more temperatures of the engine 12 (e.g., the engine temperature Teng, the coolant temperature Tcool and/or the oil temperature Toil). The modifier module 162 generates a modifier signal 225 that indicates the modifier value. The modifier value MOD is used to modify the offset value OFFSET at task 224. The modifier value may be a value greater than or equal to zero (0) and less than or equal to one (1). In one implementation the modifier value is determined (looked up) using a modifier table (third table) 223 that relates modifier values to temperatures of the engine 12. The modifier table 223 may be stored in the memory 150.

At 224, the FCM 20 and/or the rail pressure control module 164 adjusts the target rail pressure Ptarg determined at 212 based on the offset value OFFSET and the modifier value MOD to generate an adjusted target fuel rail pressure Padj (227) (shown in FIG. 3). The adjusted fuel rail pressure Padj may be determined using, for example, equation 1.

$$Padj = Ptarg + OFFSET \cdot MOD \quad (1)$$

At 226, the FCM 20 and/or the rail pressure control module 164 adjust the current fuel rail pressure based on the adjusted target fuel rail pressure and the mode signal MODE. The rail pressure control module 164 generates the high-pressure pump signal HIGH and/or the high-pressure valve signal based on the adjusted target fuel rail pressure determined at 224. The high-pressure valve signal may be provided to the high-pressure pump assembly 70 to control, for example, a solenoid of the high-pressure valve 120. The high-pressure valve signal may be used to adjust the open time and/or extent to which the high-pressure valve 120 is open.

At 228, the FCM 20 and/or the fuel injector control module 166 may adjust the fuel injector signals INJ based on the mode signal MODE and based on and/or as a function of the adjusted target fuel rail pressure and/or the current fuel rail pressure. For example, if the adjusted target fuel rail pressure is greater than the current rail pressure, then the fuel rail pressure in the fuel rail 72 is to be increased and the injector ON (or OPEN) time may be decreased. This may be done to maintain a current amount of fuel being supplied to the cylinders 16 (fuel supply rate) of the engine 12. The rail pressure may be increased and the injector ON time may be decreased by adjusting respective ON time pulse widths, frequencies and/or duty cycles of signals provided to the high-pressure valve and the fuel injectors 22. Example PWM signals are shown in FIG. 5. The method may end at 230.

In FIG. 5, a plot of a high-pressure valve signal 250 and a fuel injector signal 252 is shown. The high-pressure valve signal 250 and the fuel injector signal 252 illustrate an example when fuel rail pressure is increased and fuel injector ON time is decreased. This may occur, for example when switching from the high-pressure mode to the normal pressure mode. This may also occur when operating in the continuous pressure adjusting mode.

The high-pressure valve signal 250 and the fuel injector signal 252 include two states of operation. Dashed line 254 refers to a transition between the first and second states. During the first state, the high-pressure valve signal 250 has a first ON time pulse width PW1 and the fuel injector signal 252 has a second ON time pulse width PW2. During the second state, the high-pressure valve signal 250 has a third ON time pulse width PW3 and the fuel injector signal has a fourth ON time pulse width PW4. Although in the example of FIG. 5 ON time pulse widths, frequencies and duty cycles are adjusted, fuel rail pressures may be adjusted by altering ON time pulse widths, frequencies and/or duty cycles.

The above-described tasks are meant to be illustrative examples; the tasks may be performed sequentially, synchronously, simultaneously, continuously, during overlapping time periods or in a different order depending upon the application.

The above-described implementations allow set points for a high-pressure fuel rail on SIDI systems to be modified based on engine temperatures. This can reduce particulate output of an engine. For example, fuel rail pressure may be increased during a cold start to improve stratified fuel charging of a cylinder, which prevents fuel from impinging on piston and cylinder wall surfaces. This improves combustion of fuel injected into engine cylinders and mitigates particulate emissions.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel control system comprising:

a target rail pressure module that determines a target fuel rail pressure of a fuel rail of a direct injection engine, wherein fuel supplied from the fuel rail to the direct injection engine is directly injected from a fuel injector into a cylinder of the direct injection engine;

an offset module that determines an offset value based on an engine speed and at least one of an engine load and an amount of air per cylinder of the direct injection engine;

a modifier module that determines a modifier value based on a temperature of the direct injection engine, wherein the modifier value is different than the offset value; and a fuel control module configured to if the temperature is greater than or equal to a predetermined temperature, operate in a first mode, if the temperature is less than the predetermined temperature, operate in a second mode, wherein the temperature of the direct injection engine is less than the predetermined temperature due to a cold start of the direct injection engine, while operating in the first mode, operating in the second mode, and transitioning between the first mode and the second mode for stratified charging of the fuel in the cylinder and to minimize an amount of fuel impinging on cylinder walls or top surfaces of pistons in the direct injection engine, maintain a same amount of fuel being injected into the cylinder of the direct injection engine by one of (i) increasing a current fuel rail pressure via a valve of a first fuel pump and decreasing an amount of ON time per fuel injection pulse of the fuel injector of the cylinder of the direct injection engine, and (ii) decreasing the current fuel rail pressure and increasing the amount of ON time per fuel injection pulse of the fuel injector of the cylinder of the direct injection engine, during the second mode and while maintaining the same amount of fuel being injected into the cylinder of the direct injection engine, adjusting the current fuel rail pressure of the fuel rail via the valve based on the target fuel rail pressure, the offset value and the modifier value, and during the first mode and while maintaining the same amount of fuel being injected into the cylinder of the direct injection engine, adjusting the current fuel rail pressure of the fuel rail via the valve based on the target fuel rail pressure and not based on the offset value and the modifier value.

2. The fuel control system of claim 1, wherein:

the first mode is a first pressure mode and the second mode is a second pressure mode; and the target fuel rail pressure is greater during the second pressure mode than a highest target fuel rail pressure used during the first pressure mode.

3. The fuel control system of claim 1, wherein the fuel control module adjusts the target fuel rail pressure to generate an adjusted fuel rail pressure signal based on a product of the offset value and the modifier value.

4. The fuel control system of claim 1, wherein:

the fuel control module adjusts the target fuel rail pressure to generate an adjusted fuel rail pressure signal based on a sum of (i) the target fuel rail pressure, and (ii) a product of the offset value and the modifier value;

the offset value indicates an amount of pressure to increase or decrease the target fuel rail pressure; and the offset module determines the offset value based on the engine speed, the engine load and the amount of air per cylinder.

5. The fuel control system of claim 1, wherein the modifier value is limited to being greater than or equal to 0 and less than or equal to 1.

6. The fuel control system of claim 1, wherein:

the fuel control module generates a valve signal based on the target fuel rail pressure, the offset value and the modifier value to adjust ON time of the valve in a fuel pump assembly; and the fuel pump assembly includes the first fuel pump.

7. The fuel control system of claim 1, further comprises:

a second fuel pump that pumps fuel from a fuel tank to a fuel line, wherein pressure in the fuel line is at a first pressure; and a fuel pump assembly that comprises the first fuel pump that pumps fuel from the fuel line to the fuel rail, wherein pressure in the fuel rail is at a second pressure, and wherein the second pressure is greater than the first pressure in the fuel line, and the valve that adjusts pressure in the fuel rail based on a valve signal, wherein the fuel control module generates the valve signal based on the target fuel rail pressure, the offset value and the modifier value.

8. The fuel control system of claim 1, wherein:

the target rail pressure module determines the target fuel rail pressure using a first table that relates target fuel rail pressures to engine speed and at least one of engine loads and air per cylinder values;

the offset module determines the offset value using a second table that relates offset values to engine speeds and at least one of engine loads and air per cylinder values; and the modifier module determines the modifier value using a third table that relates modifier values to engine temperatures.

9. A fuel control method comprising:

determining a target fuel rail pressure of a fuel rail of a direct injection engine based on an engine speed of the direct injection engine and at least one of an engine load and an amount of air per cylinder, wherein fuel supplied from the fuel rail to the direct injection engine is directly injected from a fuel injector into a cylinder of the direct injection engine;

determining an offset value based on the engine speed and at least one of the engine load and the amount of air per cylinder;

determining a modifier value based on a temperature of the direct injection engine, wherein the modifier value is different than the offset value;

if the temperature is greater than or equal to a predetermined temperature, operating in a first mode;

if the temperature is less than the predetermined temperature, operating in a second mode, wherein the temperature of the direct injection engine is less than the predetermined temperature due to a cold start of the direct injection engine;

while operating in the first mode, operating in the second mode, and transitioning between the first mode and the second mode for stratified charging of the fuel in the cylinder and to minimize an amount of fuel impinging on cylinder walls or top surfaces of pistons in the direct injection engine, maintaining a same amount of fuel being injected into the cylinder of the direct injection engine by one of (i) increasing a current fuel rail pressure via a valve of a first fuel pump and decreasing an amount of ON time per fuel injection pulse of the fuel injector of the cylinder of the direct injection engine, and (ii) decreasing the current fuel rail pressure via the valve and increasing the amount of ON time per fuel injection pulse of the fuel injector of the cylinder of the direct injection engine;

during the second mode and while maintaining the same amount of fuel being injected into the cylinder of the direct injection engine, adjusting the current fuel rail pressure of the fuel rail via the valve based on the target fuel rail pressure, the offset value and the modifier value; and during the first mode and while maintaining the same amount of fuel being injected into the cylinder of the direct injection engine, adjusting the current fuel rail pressure of the fuel rail via the valve based on the target fuel rail pressure and not based on the offset value and the modifier value.

10. The fuel control method of claim 9, wherein:

the first mode is a first pressure mode and the second mode is a second pressure mode; and the target fuel rail pressure is greater during the second pressure mode than a highest target fuel rail pressure used during the first pressure mode.

11. The fuel control method of claim 10, wherein, and while fuel to the direct injection engine is enabled, the current fuel rail pressure is not adjusted based on the offset value and the modifier value when operating in the first mode.

12. The fuel control method of claim 9, further comprising adjusting the target fuel rail pressure to generate an adjusted fuel rail pressure signal based on a sum of (i) the target fuel rail pressure, and (ii) a product of the offset value and the modifier value, wherein:

the modifier value is greater than or equal to 0 and less than or equal to 1;

the offset value indicates an amount of pressure to increase or decrease the target fuel rail pressure; and the offset value is determined based on the engine speed, the engine load and the amount of air per cylinder.

13. The fuel control method of claim 9, further comprising generating a valve signal based on the target fuel rail pressure, the offset value and the modifier value to adjust ON time of the valve in a fuel pump assembly, wherein the fuel pump assembly includes the first fuel pump.

14. The fuel control method of claim 9, further comprising:

pumping fuel from a fuel tank to a fuel line, wherein pressure in the fuel line is at a first pressure;

pumping fuel from the fuel line to the fuel rail, wherein pressure in the fuel rail is at a second pressure, and wherein the second pressure is greater than the first pressure in the fuel line;

adjusting pressure in the fuel rail based on a valve signal; and generating the valve signal based on the target fuel rail pressure, the offset value and the modifier value.

15. The fuel control system of claim 1, wherein:

while transitioning from the second mode to the first mode, the fuel control module is configured to decrease the current fuel rail pressure and increase the ON time per fuel injection pulse of the cylinder of the direct injection engine; and while transitioning from the first mode to the second mode, the fuel control module is configured to increase the current fuel rail pressure and decrease the ON time per fuel injection pulse of the cylinder of the direct injection engine.

16. The control system of claim 1, wherein the fuel control module is configured to:

while transitioning from the second mode to the first mode, decrease a first duty cycle of a pressure signal and increase a second duty cycle of a fuel injector signal of the cylinder of the direct injection engine, wherein the pressure signal indicates the current fuel rail pressure; and while transitioning from the first mode to the second mode, increase the first duty cycle of the pressure signal and decrease the second duty cycle of the fuel injector signal of the cylinder of the direct injection engine.

17. The control system of claim 1, wherein:

while transitioning from the second mode to the first mode, decrease a first frequency of a pressure signal and increase a second frequency of a fuel injector signal of the cylinder of the direct injection engine, wherein the pressure signal indicates the current fuel rail pressure; and while transitioning from the first mode to the second mode, increase the first frequency of the pressure signal and decrease the second frequency of the fuel injector signal of the cylinder of the direct injection engine.

18. A fuel control system comprising:

a target rail pressure module that determines a target fuel rail pressure of a fuel rail of a direct injection engine;

an offset module that determines an offset value based on an engine speed and at least one of an engine load and an amount of air per cylinder of the direct injection engine;

a modifier module that determines a modifier value based on a temperature of the direct injection engine, wherein the modifier value is different than the offset value; and a fuel control module that adjusts a current fuel rail pressure of the fuel rail via a valve of a fuel pump for stratified charging of fuel in the cylinder and to minimize an amount of fuel impinging on cylinder walls or top surfaces of pistons in the direct injection engine during a cold start of the direct injection engine, wherein the fuel control module adjusts the current fuel rail pressure of the fuel rail via the valve based on the target fuel rail pressure, the offset value and the modifier value such that a resulting fuel rail pressure is equal to a sum of (i) the target fuel rail pressure, and (ii) a product of the offset value and the modifier value.

19. The fuel control system of claim 18, wherein:

the fuel supplied from the fuel rail to the direct injection engine is directly injected from a fuel injector into the cylinder of the direct injection engine; and the fuel control module configured to if the temperature is greater than or equal to a predetermined temperature, operate in a first mode, if the temperature is less than the predetermined temperature, operate in a second mode, wherein the temperature of the direct injection engine is less than the predetermined temperature due to the cold start of the direct injection engine, while operating in the first mode, operating in the second mode, and transitioning between the first mode and the second mode and to minimize the amount of fuel impinging on the cylinder walls or top surfaces of the pistons in the direct injection engine, maintain a same amount of fuel being injected into the cylinder of the direct injection engine by one of (i) increasing the current fuel rail pressure via the valve and decreasing an amount of ON time per fuel injection pulse of the fuel injector of the cylinder of the direct injection engine, and (ii) decreasing the current fuel rail pressure via the valve and increasing the amount of ON time per fuel injection pulse of the fuel injector of the cylinder of the direct injection engine, during the second mode and while maintaining the same amount of fuel being injected into the cylinder of the direct injection engine, adjusting the current fuel rail pressure of the fuel rail via the valve based on the target fuel rail pressure, the offset value and the modifier value, and during the first mode and while maintaining the same amount of fuel being injected into the cylinder of the direct injection engine, adjusting the current fuel rail pressure of the fuel rail via the valve based on the target fuel rail pressure and not based on the offset value and the modifier value.

20. The fuel control system of claim 19, wherein:

the first mode is a first pressure mode and the second mode is a second pressure mode; and the target fuel rail pressure is greater during the second pressure mode than a highest target fuel rail pressure used during the first pressure mode.

* * * * *